US005240258A

United States Patent [19]

Bateman

[11] Patent Number: 5,240,258

[45] Date of Patent: Aug. 31, 1993

[54] VERSATILE POPUP/KNOCK-DOWN TARGET SYSTEM

[76] Inventor: Kyle E. Bateman, P.O. Box 636, Provo, Utah 84603-0636

[21] Appl. No.: 843,154

[22] Filed: Feb. 28, 1992

[51] Int. Cl.[5] ..... F41J 1/00

[52] U.S. Cl. ..... 273/392; 273/406

[58] Field of Search ..... 273/392, 406, 407

[56] References Cited

U.S. PATENT DOCUMENTS 3,392,980 7/1968 Ortega ..... 273/406
4,714,256 12/1987 Mosser ..... 273/392
5,163,689 11/1992 Bateman ..... 273/406

*Primary Examiner*—William H. Grieb

[57] ABSTRACT

A target support structure and system which accommodates the use of various target adapters, including a reactive steel plate, a plastic target holder, and a 1×2 lumber holder. The system provides for quick and simple changing of target types and allows for the convenient adjustment of the desired angle for any target which is used. When the target is hit, it falls over backwards, activating an internal position sensor. Then, when an internal reset mechanism is engaged, the plate is lifted back to the upright position. The system is easily mounted for permanent or portable use, may be activated through pneumatics or any adaptable power source, may be interfaced with electric, pneumatic, or similar control devices, may be used as a trigger device to activate other devices upon being hit, and is designed to minimize bullet splatter.

2 Claims, 2 Drawing Sheets

FIGURE 2
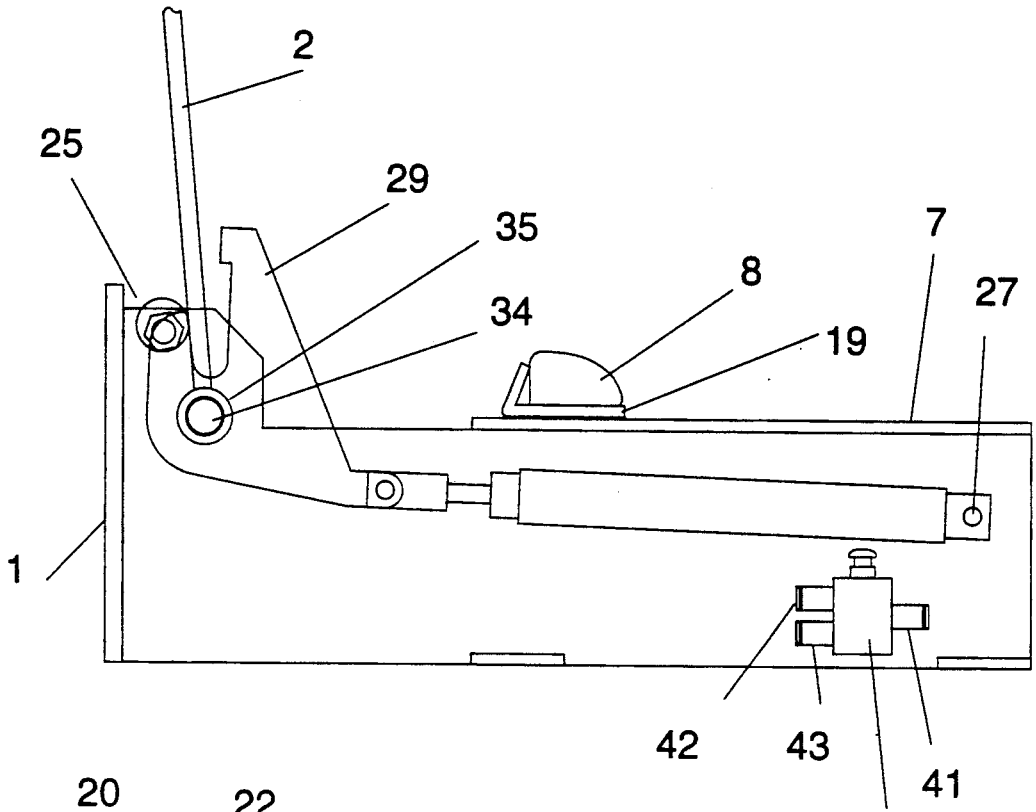
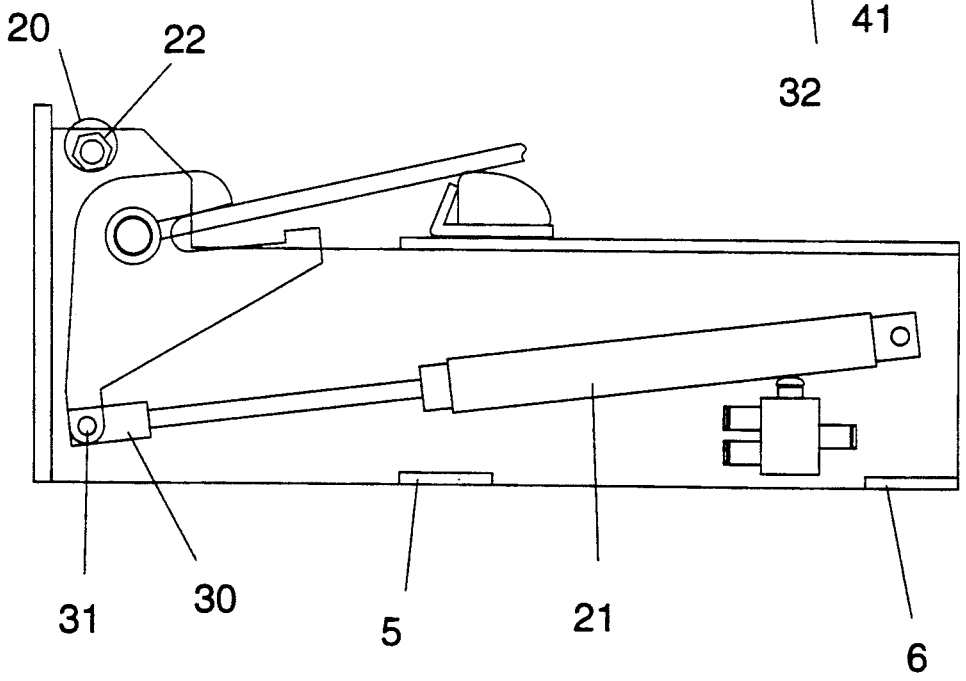
FIGURE 3

VERSATILE POPUP/KNOCK-DOWN TARGET SYSTEM

BACKGROUND

Other resettable steel plate systems that are commercially available suffer from one or more disadvantages which this present invention helps remedy. These disadvantages include being larger, heavier, less portable, relatively slow reacting, relatively complex, incapable of independent operation, inefficient, incapable of "chain-reaction" operation (where one target triggers a subsequent target), insufficiently armored, or incapable of accommodating a variety of adapters for use with both reactive steel and permeable targets. The only known art incorporating some of the same advantages of this present invention are additional inventions by the same applicant for this invention. (See application Ser. No. 672,453 - "Turning Target Support Structure and System," now U.S. Pat. No. 5,163,689, and "Automated Steel Knock-Down Target System" (co-pending application Ser. No. 07/843,427). These other inventions incorporate some of the same armoring techniques and control devices, but each invention has unique characteristics which are not apparent modifications to one skilled in the art.

SUMMARY

It is an object of the present invention to provide an improved versatile popup/knock-down target system comprising:

(a) A mounting base quickly and easily adaptable to either permanent installation on improved surfaces or, portable use on a wide range of surfaces.

(b) A popup/knock-down target assembly mounted to the top of and inside said base;

(c) A design for protecting the system support structure and minimizing bullet splatter, which design allows the attachment of a 2×6 board or similar facade to the front shield;

(d) A design which allows both optimum target plate angle for splatter containment, and calibration for light bullet loads.

(e) A trap for catching downward splatter which otherwise could return toward the shooter.

(f) A sensor switch to detect the hit zone plate being knocked down in response to a successful bullet hit.

(g) A mounting method for the sensor switch which detects the angle of the activator piston rather than using a direct mechanical interface with the hit zone plate which could cause damage or premature failure of the switch mechanism due to the heavy forces exerted by the hit zone plate as it falls to the horizontal position.

(h) A design which allows connection of the sensor switch directly into the activator piston such that the head plate will reset itself automatically each time it is knocked down.

(i) A design which allows connection of the sensor switch to external devices such as other targets such that they will be activated when the head plate is knocked down.

(j) An electric valve option such that the lifting and the knock down action of the hit zone plate can be controlled remotely from a computer or some other type of electronic device.

(k) A design which allows operation of reactive steel plates, standard plastic, cardboard and paper targets, by the simple installation of a target adapter in a matter of seconds.

(l) A design which allows target adapters to be installed in a matter of seconds.

BRIEF DESCRIPTION OF THE DRAWINGS

FIG. 2 shows a side angle exposing the inside of an embodiment of the versatile popup/knock-down target system with the targer plate vertical in accordance with the present invention;

FIG. 3 shows a side angle exposing the inside of an embodiment of the versatile popup/knock-down target system with the target plate horizontal in accordance with the present invention;

DESCRIPTION OF THE PREFERRED EMBODIMENT

Figure 1:
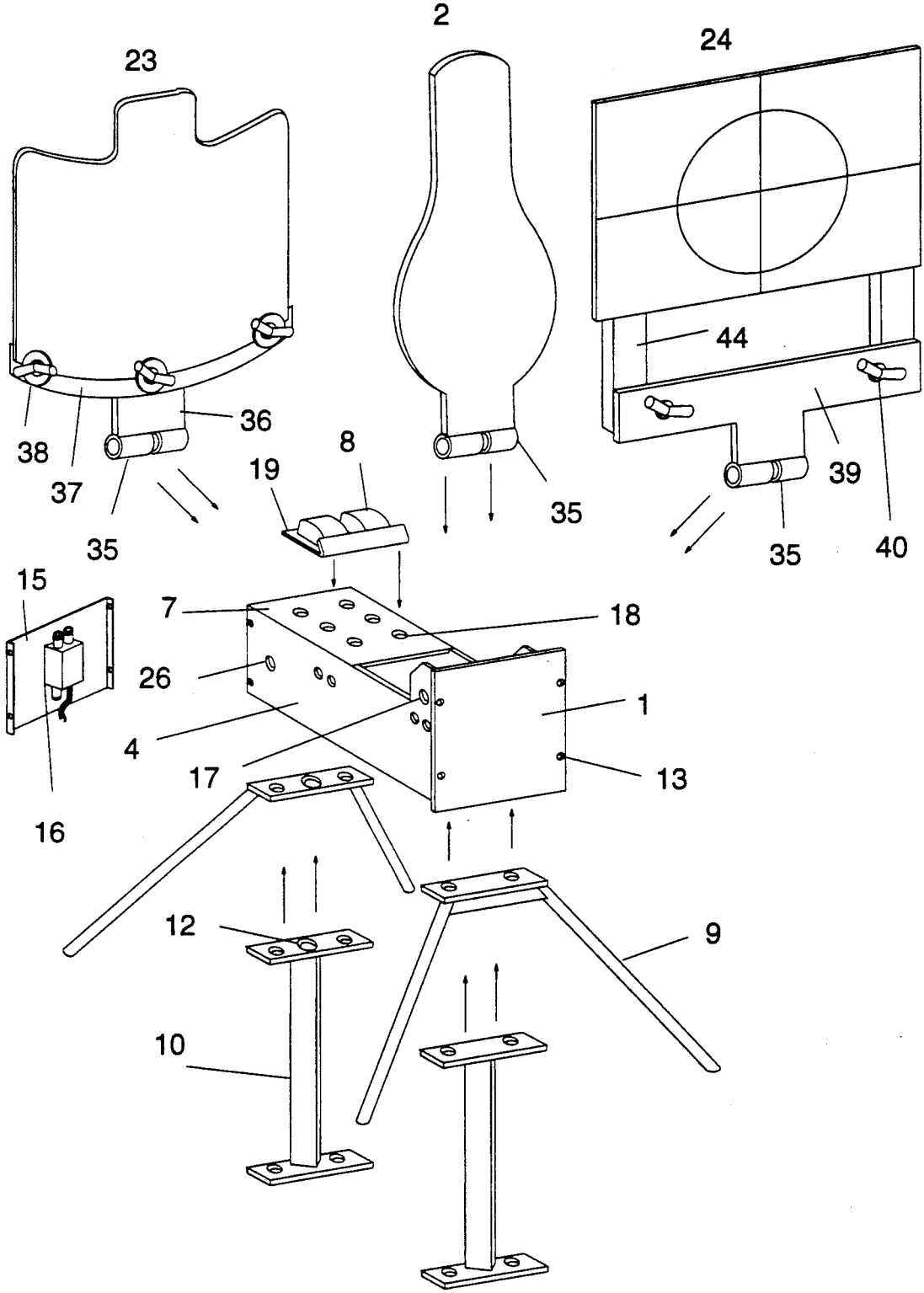
FIG. 1 shows a front angle of an embodiment of the versatile popup/knock-down target system with three embodiments of adapters, an embodiment of the optional rear cover and electric valve, and embodiments of two types of legs in accordance with the present invention.

Referring to the accompanying drawings, there is illustrated a preferred embodiment of the Versatile Popup/Knock-down Target System according to the present invention. Most of the target system is preferably fabricated from hot rolled mild steel. The front shield (1) and reactive steel plate (2) are preferably fabricated from abrasion resistant steel plate.

The base is comprised of the front shield (1), the side plates (4), the bumper plate (7), a front leg mount (5), and a rear leg mount (6) which are welded together. The front shield (1) forms a barrier to protect the embodiment and its internal components from bullet hits. The front shield (1) has facade mounting holes (13) around its edge through which a variety of facades can be bolted. Attached to the back side of the front shield (1) are the two side plates (4). The side plates (4) are held together by the bumper plate (7) on the top, and the leg mounts (5)(6) on the bottom. The side plates (4) are recessed slightly from the edges of the front shield (1) to allow the facade mounting holes (13) to be easily accessed from the outside of the chamber formed by the front shield (1), the side plates (4), and the bumper plate (7). This chamber can be further enclosed by an optional back cover plate, (15) to protect internal components and also to allow for the mounting of the optional electric valve (16) for circumstances where electric triggering is required.

The holes (11) in the leg mounts (5)(6) form a mating surface onto which the legs (10) can be bolted to allow mounting of the embodiment on a concrete surface. As an option, wider base legs (9) may be attached to the same leg mounts (5)(6) for operation in portable applications. A conduit access hole (12) is provided in the center of the rear leg (10) and the associated wider leg (9) and leg mount (6) through which air supply and electrical signal lines can be run to operate the embodiment.

The large holes (17) in the side plates (4) are used to form the main pivot point for the particular target adapter being used. Various possible target adapters include a reactive steel plate (2), a plastic target holder (23), and a 1×2 lumber holder (24). When the target adapter is in the horizontal position, it comes to rest on two rubber bumpers (8) which are attached to the bumper plate (7) in one of several available sets of mounting holes (18). The bumpers (8) may be moved to a different mounting position to best accomodate the various target adapters. The bumper shield (19) is installed between the bumpers (8) and the bumper plate (7).

When the target adapter is in the vertical position, it comes to rest upon two cam stops (20) which can be rotated to adjust the exact angle of the target. Once the desired adjustment of a cam stop (20) is achieved, the holding nut (22) can be tightened to lock the adjustment in place.

The front shield (1) extends above the tops of the side plates (4) and is also placed at an appropriate distance from the front surface of the pivot holes (17) so as to create a trap (25) which is used to catch bullet splatter coming off the target adapter and prevent it from returning to the shooter.

A bolt (27) passes through two holes (26) in the side plates (4) to form a rear pivot for the activator piston (21) which, in the embodiment illustrated, is a commercially available, double acting, pneumatic piston. Two spacers (not shown) are used to hold the activator piston (21) base in a position which is centered between the two side plates (4). The front end of the activator piston (21) attaches to the lever (29) by means of the rod clevis (30) and the clevis pin (31).

Mounted to one side plate (4) just under the activator piston (21) is the knock-down sensor switch (32). This switch is a commercially available, 4-way air valve which is activated by a push-button (33).

Two large holes (17) are located in the side plates (4) through which the pivot pin (34) passes. Fabricated from round steel rod, this pin has grooves machined in each end to allow attachment of retaining clips which hold it in place. The pivot pin (34) acts as an axle around which the pivot tubes (35) and the lever (29) can turn.

The pivot tubes (35) are attached at the base of the target adapter. In the case of the reactive steel plate (2), the plate itself is welded directly to the pivot tubes. In the case of the plastic target holder, the lifter arm (36) is welded to the pivot tubes and the target clamp bracket (37) is welded to the opposite end of the lifter arm (36). Located along the surface of the clamp bracket (37) are the three target clamps (38) which hold the target, in place. In the case of the 1×2 lumber holder, the T-bar (39) is welded to the pivot tubes. Located at each end of the T-bar (39) are the two lumber clamps (40).

The operation of the preferred embodiment of this present invention is basically as follows: first, the legs (10) are optionally attached to a solid surface. The front shield (1) is designed to have a facade attached to prevent bullet splatter and to provide additional protection to the embodiment. Specifically, the bullet passes through the soft facade and strikes the front shield (1). Upon impact, the bullet mushrooms against the steel surface and is safely captured in the facade rather than being allowed to splatter back toward the shooter. The facade, which in the preferred embodiment is constructed of wood, can advantageously be easily and economically replaced as needed.

Power is provided to the system by means of one or more air supply hoses (not shown) which may enter through the conduit access hole (12). These hoses may connect directly to the activator piston (21) if desired. Or, switching of the air supply may be accomplished by the electric valve (16), the knock-down sensor switch (32), or other external devices which are not part of this present invention.

If the air flow is directed to retract the activator piston (21), the target adapter will be lifted to the vertical position. Then (assuming the reactive steel plate is being used), once the air pressure has been removed, the reactive steel plate (2) will be free to be knocked down by a bullet. If the air flow is directed to extend the activator piston (21), the target adapter will be pulled down to the horizontal position where it is out of view of the shooter. The downward motion of the target adapter is cushioned by the rubber bumpers (8) to avoid excess shock to the embodiment.

The lever (29) is not attached rigidly to the target adapter. This aids in the process of changing to alternate target adapters since there is no need to disconnect the activator piston (21) from the lever (29). Rather, the user simply removes the pivot pin (34), replaces the target adapter, and then reinserts the pivot pin (34).

For maximum safety from bullet splatter, it is ideal for a steel target plate to be tipped slightly forward toward the shooter. This is generally not possible on larger knock-down targets since putting the plate that far forward generally makes it impossible to knock down with a standard handgun bullet. However, because of the unique horizontal mounting design of the activator piston (21), the downward force of gravity provides a small amount of torque on the target adapter which aids it in falling backward. This enables the reactive steel plate (2) to be adjusted for lower power factor bullets while still retaining optimum forward angle for safety.

The bumper shield (19) forms a protective barrier on the front of the rubber bumpers (8) to help prevent them from being damaged by errant bullets. However, in the case where the rubber bumpers (8) are damaged (or torn away completely) the bumper guard provides a secondary stop surface to prevent the falling motion of the target adapter from damaging the activator piston (21) or other components.

The knock-down sensor switch (32) is used to switch an air flow based upon the position of the target adapter. When the target adapter is in the vertical position, the push-button (33) is not pressed so air flows in the supply input (41) and out the "normally on" output (42). When the target adapter is in the horizontal position, the activator piston (21) rocks downward and presses the push-button (33) so the air will flow out the "normally off" output (43). The knock-down sensor switch (32) may be used to reset the reactive steel plate (2) automatically or, to direct air flow for a variety of other uses including the operation of other targets in a "chain reaction" sequence.

The design of the plastic target holder (23) provides for the attachment of a standard, commercially available plastic, or in some cases cardboard, target such as is commonly used in police and military firearms training. The clamp bracket (37) is shaped in an arc so that it will hold the target sheet in an arc of the same shape. This creates strength in the target so it will not bend over or break as it is being lifted up.

The 1×2 lifter (24) is designed to hold smaller cardboard or paper targets such as are commonly used by police and sport shooters. Each lumber clamp (40) holds a 1×2 lumber strip (44) firmly in place such that it extends upward from the embodiment. At the desired height, the user may attach a target to the wood strips using tape or a staple gun.

It is understood that the present invention is not limited to the preferred embodiment presented but is susceptible to a number of modifications as are apparent to one skilled in the art. I do not, therefore, wish to limit the present invention to the detail shown and described herein, but intend to cover all modifications which are obvious to one skilled in the art.

The embodiments of the invention in which an exclusive property or privilege is claimed are defined as follows:

1. An improved versatile popup/knock-down target system comprising:

(a) A mounting base quickly and easily adaptable to either permanent installation on improved surfaces or, portable use on a wide range of surfaces;

(b) A popup/knock-down target assembly mounted to the top of and inside said base;

(c) A means for protecting the system support structure and minimizing bullet splatter, which allows the attachment of a 2×6 facade to the front shield;

(d) A means which allows both optimum target plate angle for splatter containment, and calibration for light bullet loads;

(e) A trap for catching downward splatter which otherwise could return toward the shooter;

(f) A sensor switch to detect the hit zone plate being knocked down in response to a successful bullet hit;

(g) A mounting means for the sensor switch which detects the angle of the activator piston rather than using a direct mechanical interface with the hit zone plate which could cause damage or premature failure of the switch mechanism due to the heavy forces exerted by the hit zone plate as it falls to the horizontal position;

(h) A means which allows connection of the sensor switch directly into the activator piston such that the head plate will reset inself automatically each time it is knocked down;

(i) A means which allows connection of the sensor switch to external devices such as other targets such that they will be activated when the head plate is knocked down;

(j) An electric valve option such that the lifting and the knock down action of the hit zone plate can be controlled remotely from an electric control device;

(k) A means which allows operation of reactive steel plates, standard plastic, cardboard and paper targets, by the simple installation of a target adapter in a matter of seconds;

(l) A means which allows target adapters to be installed in a matter of seconds.

2. A system according to claim 1 wherein the target movement is actuatable through pneumatics or any adaptable power source and is compatible for interface with either an electric or a pneumatic control device.

* * * * *